US007290311B2

(12) United States Patent
Vosbikian et al.

(10) Patent No.: US 7,290,311 B2
(45) Date of Patent: Nov. 6, 2007

(54) IMPLEMENTS WITH HANDLES AND WORKING ENDS AND METHOD OF USE THEREOF

(75) Inventors: Peter S. Vosbikian, Moorestown, NJ (US); Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 11/425,779

(22) Filed: Jun. 22, 2006

(65) Prior Publication Data

US 2006/0248684 A1 Nov. 9, 2006

Related U.S. Application Data

(62) Division of application No. 10/804,541, filed on Mar. 19, 2004.

(51) Int. Cl.
*B25G 3/32* (2006.01)
*A47F 7/00* (2006.01)

(52) U.S. Cl. ..... 16/422; 16/427; 211/70.6

(58) Field of Classification Search ..... 16/900, 16/422, 426, 430, 110.1, 114 R, 115, 436, 16/DIG. 19, 24; 403/359.1, 222, 19, 377; 74/543, 557; 15/144.1, 143.1; 206/225; 211/70.6

See application file for complete search history.

(56) References Cited

U.S. PATENT DOCUMENTS

| | | | | |
|---|---|---|---|---|
| 226,891 | A * | 4/1880 | Tym | 206/216 |
| 378,540 | A | 2/1888 | Brough | |
| 577,220 | A | 2/1897 | Whitehead | |
| 1,027,209 | A | 5/1912 | Margolius | |
| 1,750,845 | A | 3/1930 | Lach | |
| 1,913,105 | A * | 6/1933 | Case et al. | 206/362 |
| 2,423,292 | A * | 7/1947 | Brown | 211/65 |
| 2,639,454 | A * | 5/1953 | Dory | 15/245 |
| 3,153,252 | A | 10/1964 | Ricciardi | |
| 3,226,149 | A * | 12/1965 | McJohnson | 294/50 |
| 3,359,929 | A | 12/1967 | Carlson | |
| 3,380,097 | A | 4/1968 | Pharris | |
| 3,407,424 | A | 10/1968 | Lanzarone et al. | |
| 3,600,740 | A | 8/1971 | Ogler | |
| 3,819,034 | A * | 6/1974 | Clark | 206/763 |
| 4,070,128 | A | 1/1978 | Garrison | |
| 4,082,186 | A | 4/1978 | Chirumbolo | |
| 4,132,489 | A | 1/1979 | Berg, Jr. et al. | |
| 4,329,755 | A | 5/1982 | Alissandratos | |
| 4,524,484 | A | 6/1985 | Graham | |

(Continued)

OTHER PUBLICATIONS

Quickie Prod. No. 064 & .067—See attachment.

(Continued)

*Primary Examiner*—Robert J. Sandy
(74) *Attorney, Agent, or Firm*—Wildman, Harrold, Allen & Dixon, LLP

(57) ABSTRACT

Implements including handles and working ends and product lines thereof are described. The implements are typically cleaning implements, such as mops mad brooms, but may be garden implements such as hoes and rakes. Various methods for using such implements are described. In one aspect, the methods relate to shipping the implements, each of which includes the same overall, length. In another aspect, the methods relate to displaying the implements, most often in a retail environment for presentation to consumers.

21 Claims, 7 Drawing Sheets

U.S. PATENT DOCUMENTS

| | | | | |
|---|---|---|---|---|
| 4,638,522 | A | 1/1987 | Robertson | |
| 4,667,829 | A | 5/1987 | Edmund-White | |
| 4,769,869 | A | 9/1988 | Benitez | |
| 4,926,522 | A | 5/1990 | Want | |
| 4,971,374 | A | 11/1990 | Lovell et al. | |
| 5,435,040 | A | 7/1995 | McClure | |
| 5,502,862 | A | 4/1996 | Vosbikian | |
| D375,035 | S | 10/1996 | Mangol | |
| 5,573,115 | A | 11/1996 | Fuller | |
| 5,606,761 | A * | 3/1997 | Lynch | 15/144.4 |
| 5,609,255 | A | 3/1997 | Nichols | |
| 5,661,868 | A | 9/1997 | Panagakos et al. | |
| 5,743,580 | A | 4/1998 | Evans | |
| 5,810,408 | A | 9/1998 | Armstrong | |
| 5,887,314 | A * | 3/1999 | Jordan, Jr. | 16/405 |
| 5,971,141 | A * | 10/1999 | Shafik | 206/225 |
| 6,134,743 | A | 10/2000 | Schmidt | |
| 6,199,245 | B1 | 3/2001 | Blessing | |
| 6,439,630 | B1 | 8/2002 | Eatmon | |
| D463,961 | S | 10/2002 | Hoshyla | |
| 6,530,487 | B1 * | 3/2003 | Berry | 211/70.6 |
| 6,581,776 | B2 | 6/2003 | Zatkoff | |
| 6,850,208 | B1 * | 2/2005 | Ferrante | 345/1.1 |
| 6,865,776 | B2 * | 3/2005 | Spinelli | 16/110.1 |
| 6,902,060 | B2 | 6/2005 | Michelson et al. | |
| 7,036,668 | B2 * | 5/2006 | Udy | 211/70.6 |
| 7,040,493 | B2 * | 5/2006 | Lin | 211/70.6 |
| 2003/0204926 | A1 * | 11/2003 | Jurgens et al. | 15/144.3 |

OTHER PUBLICATIONS

Quickie Prod. No. 096—See attachment.
Quickie Prod. No. 002, 002 and 003—See attachment.
Quickie Prod. No. 012—See attachment.

* cited by examiner

IMPLEMENTS WITH HANDLES AND WORKING ENDS AND METHOD OF USE THEREOF

CROSS-REFERENCE TO RELATED APPLICATIONS

This application is a divisional of prior application Ser. No. 10/804,541, filed Mar. 19, 2004.

FIELD OF THE INVENTION

This invention relates to implements comprising handles and working ends, such as brooms or mops, and more particularly to methods of use for such implements.

SUMMARY OF THE INVENTION

Implements comprising handles and working ends are disclosed.

In one embodiment, an implement of the presently claimed invention comprises a handle including a first end and a second end, wherein a length extending between the first and second ends is within a range of about 15.0 inches to about 47.0 inches, and a working end including a top portion and a bottom portion, wherein the first end of the handle is attached to the top portion of the working end and a handle-attachment member adapted to extend the handle length, wherein the handle-attachment member includes a handle-attachment member length within a range of 12 inches to 20 inches.

In a second embodiment, the presently claimed invention is directed to a product line comprising a plurality of implements, in which each of the plurality of implements has a working end and a corresponding handle, wherein a relationship exists between two or more implements each having different working ends, such that as a length of the working end increases, the length of the corresponding handle decreases.

In a third embodiment, a method of the presently claimed invention comprises the steps of providing a plurality of implements, each comprising a handle and a working end, the handle including a first end and a second end and the working end including a top portion and a bottom portion, wherein the first end of the handle is attached to the top portion of the working end, wherein each of the implements includes substantially the same overall length, measured from the second end of the handle to the bottom portion of the working end, corresponding to a first length, and wherein the first length of the implements is extendable to a second length, providing a shipping container including a dimension adapted to receive the first length of the plurality of implements, placing the plurality of implements in the shipping container, and sending the shipping container to a destination.

In a fourth embodiment, a method of the presently claimed invention comprises the steps of providing a plurality of implements, each comprising a handle and a working end, the handle including a first end and a second end and the working end including a top portion and a bottom portion, wherein the first end of the handle is attached to the top portion of the working end, wherein each of the implements includes substantially the same length, measured from the second end of the handle to the bottom portion of the working end, corresponding to a first length within the range of about 20 inches to about 48 inches, and wherein the first length of the implements is extendable to a second length, providing a shipping container including a dimension adapted to accommodate the first length of the plurality of implements, placing the plurality of implements in the shipping container, wherein each of the plurality of implements are sized to the first length; and sending the shipping container to a destination.

In a fifth embodiment, a method of the presently claimed invention comprises the steps of providing a plurality of implements, each comprising a handle and a working end, the handle including a first end and a second end and the working end including a top portion and a bottom portion, wherein two or more of the plurality of implements comprise different working ends and the first end of the handle is attached to a top portion of the working end and wherein each of the implements includes substantially the same length, corresponding to a first length, measured from the first end of the handle to the bottom portion of the working end, and displaying the plurality of implements in a row, wherein at least one of the second ends is substantially aligned with at least one of the bottom portions or another one of the second ends.

BRIEF DESCRIPTION OF THE DRAWINGS

Certain embodiments of the presently claimed invention are illustrated by the accompanying figures. It should be understood that the figures are not necessarily to scale and that details that are not necessary for an understanding of the invention or that render other details difficult to perceive may be omitted. It should be understood, of course, that the invention is not necessarily limited to the particular embodiments illustrated herein.

DETAILED DESCRIPTION

The present invention relates to implements comprising handles and working ends. The implements may, for example, be cleaning implements, such as mops, brooms, dusters, long-handled garden implements, such as rakes or garden hoes, or any other such implements. The term "working end," as used herein, means a portion of an implement attached to an end of a handle and capable of performing a function, such as the bristle portion on a broom or the sponge portion of a mop. The implements may be manufactured by methods known to those of skill in the art.

In accordance with one aspect of the present invention, a group of the implements, taken together, from a product line. The implements within the product line may exhibit a relationship between the lengths of their handles and working ends. As the working end length of an implement increases, the handle length typically decreases. The term "product line," as used herein, means a group of implements, two or more of which comprise different working ends.

In accordance with another aspect of the present invention, the implements may be used advantageously in various methods. In select embodiments, the implements may be used in both the shipping and retail contexts to save space and money.

Figure 1:
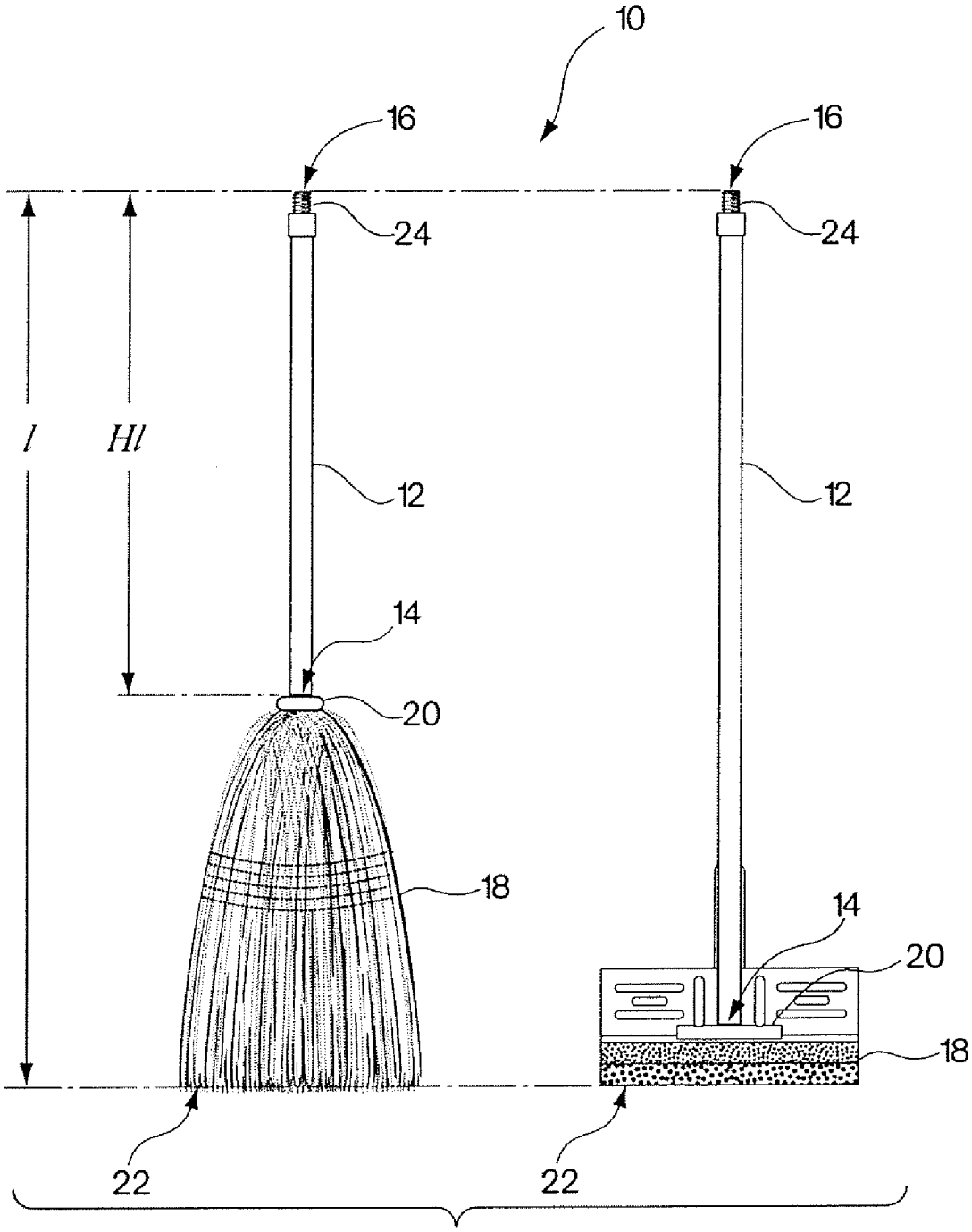
FIG. 1 is an elevated front view of two embodiments of the implements of the present invention.

Referring now to FIG. 1, two embodiments of the implements 10 of the present invention are shown. The embodiments of the implements 10 shown in FIG. 1 are cleaning implements comprising a handle 12, which includes a first end 14 and a second end 16, a working end 18, which includes a top portion 20 and a bottom portion 22. As shown in FIGS. 1A and 1B, the first end 14 of the handle 12 is attached to the top surface 20 of the working end 12 and the second end 16 of the handle 12 includes an externally threaded section 24. The first end 14 of the handle 12 may be releasably securable to the top portion 20 of the working end 12 or may be affixed thereto. Optionally, a cap (not shown) may be employed to cover the externally threaded section 24.

The distance from the second end 16 of the handle 12 to the bottom surface 22 of the working end 12, corresponding to a first length l, is substantially the same for both cleaning implements 10. In select embodiments of the present invention, the first length, l, may range from about 15.0 inches to about 50.0 inches, with a length of about 40.0 being typical.

The first length l, however, may be extended to a second length l'. The second length l' may range from about 37 inches to about 70 inches, depending on the type of implement being employed and the needs of the user. Another relevant measurement is the so-called handle length Hl, corresponding to the length of the handle from the first end 14 to the second end 16. The handle length, Hl, is typically within the range of about 10.0 inches to about 45.0 inches.

Figure 2A:
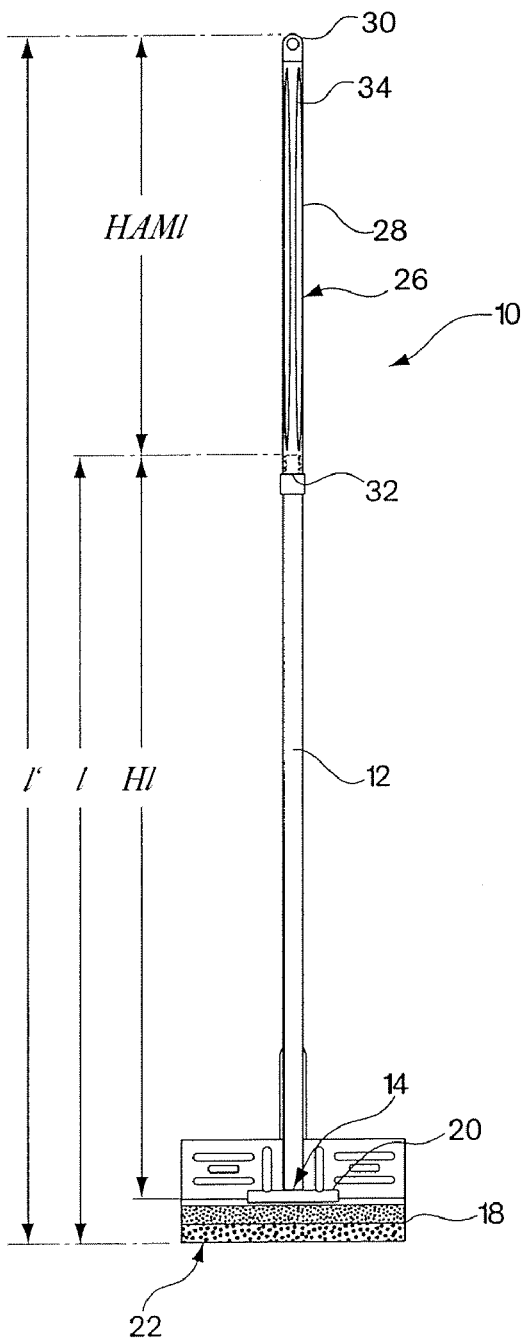
FIG. 2A is an elevated front of one embodiment of the handle-attachment member and implement of the present invention.
Figure 2B:
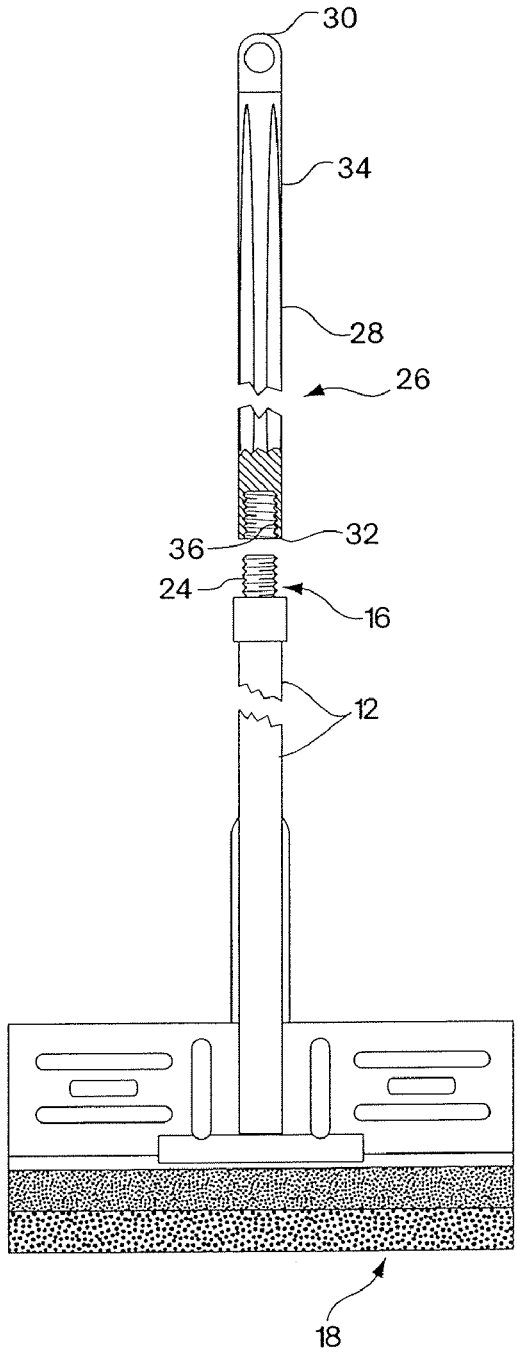
FIG. 2B is an exploded cross-sectional view of the handle-attachment member and implement of FIG. 2A taken along line A-A of FIG. 2A.

In one embodiment, the first length l may be extended to a second length l' through a handle-attachment member 26, shown in FIGS. 2A and 2B. The handle-attachment member 26 may comprise a grip. The handle-attachment member 26 of FIG. 2 comprises a hollow tube 28 with a rounded closed end 30, an open end 32 and one or more flutes 34 disposed on a surface thereof. The handle-attachment member 26 is typically manufactured as an injection molded part. The handle-attachment member 26 may also be made from other materials, such as steel or wood.

The length of the handle-attachment member 26—the handle-attachment member length HAMl—may range from about 12.0 inches to about 20.0 inches. When the length of the handle-attachment member, HAMl is within the range of about 12.0 inches and 15.0 inches, the handle length, Hl is typically between about 31.0 inches and about 47.0 inches. When the handle-attachment member length HAMl is between about 16.0 and 20.0 inches, the handle length is between about 10.0 inches and 30.0 inches.

Typically, the handle-attachment member 26 is releasably securable to the second end 16 of the handle 12 by an end-user. As shown in FIG. 2B, releasable securement may be accomplished by sliding the open end 32 of the handle-attachment member 26 over the second end 16 of the handle 12. In FIG. 2B, the handle-attachment member 26 is releasably secured to the second end 16 of the handle 12 through an internally threaded section 36, which mates with the externally threaded section 26 disposed on the first end 14 of the handle 12. The handle-attachment member 26 may also be releasably secured to the first end 14 of the handle 12 through a friction or tight slide fit, a push and twist fit, a snap fit, a magnetic connection or any other releasably securable connection known to those of skill in the art.

The first length l may be extended to the second length l', through various other means. A telescoping member, a living hinge disposed below the second end 16 of the handle 12 or any other device known to those of skill in the art may be employed for this purpose.

Figure 3:
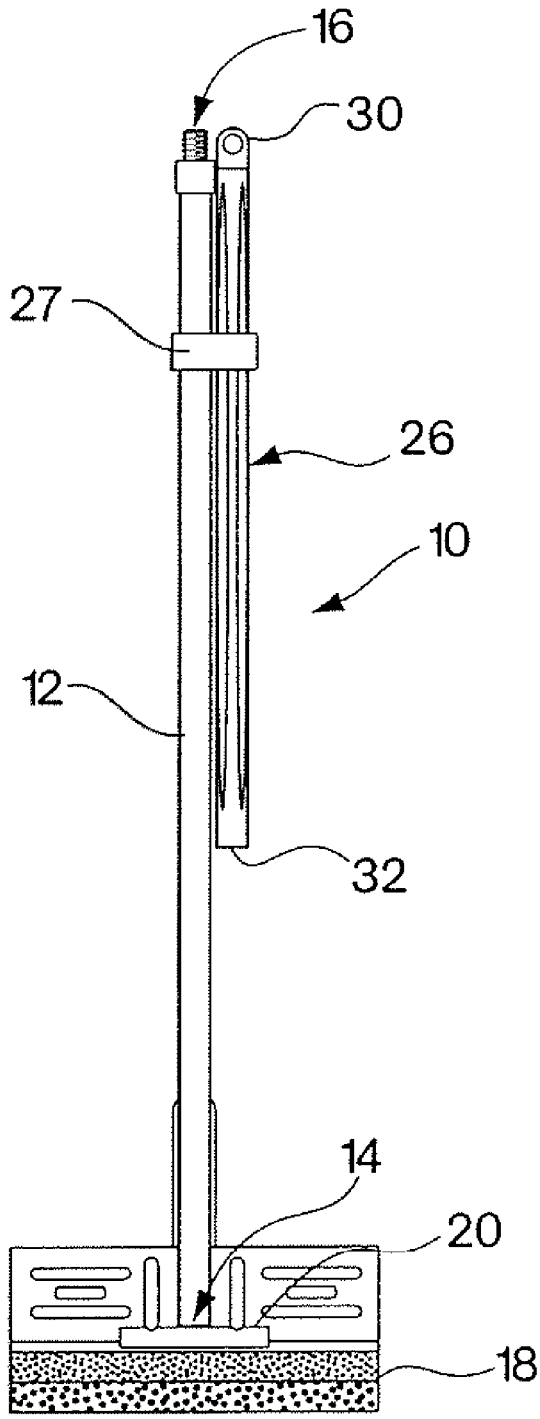
FIG. 3 is an elevated front view of one embodiment of the implement of the present invention with handle-attachment member attached to a surface thereof.

The handle-attachment member 26 may also be releasably secured to a surface of the handle 12 for shipment. As shown in FIG. 3, the handle-attachment member 26 may further comprise an annular clip 27 may be used to snap the handle-attachment member 26 to the surface of the handle 12. Alternatively or additionally, the handle-attachment member 26 may be releasably secured to the surface of the handle 12 with shrink wrap, tape, a clamshell package, hot glue and a separate card attached to both and any other methods known to those of skill in the art.

Figure 4:
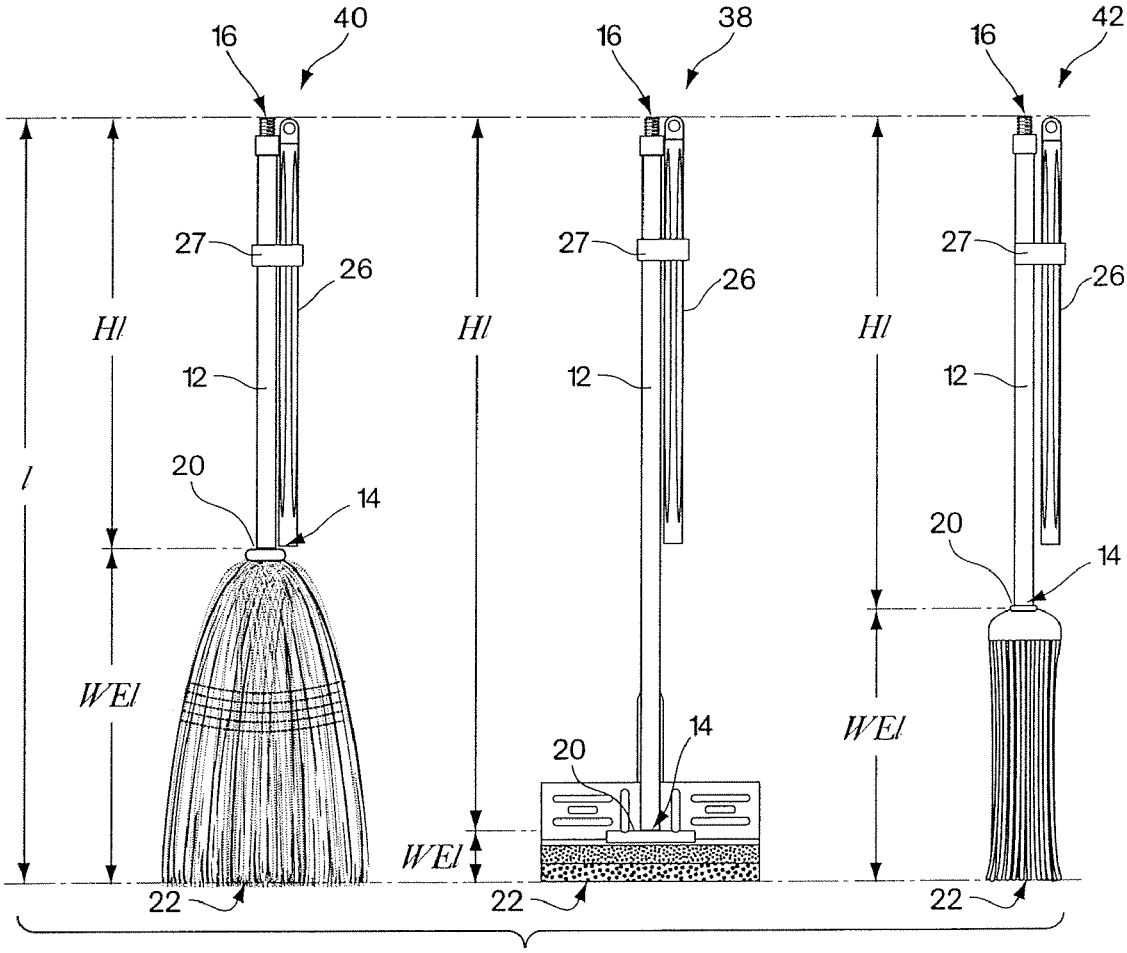
FIG. 4 is an elevated front view of one embodiment of the product line of the present invention.

Implements of the present invention may be grouped together into a product line. The product line typically comprises a group of implements with working ends designed for similar purposes, such as cleaning implements or garden implements. Referring now to FIG. 4, for example, a product line including a mop 38, broom 40 and wet mop 42 are shown. Product lines including a variety of working end types may of course be employed. A product line of garden implements may include hoe and rake working ends.

Implements within the product line may each include a working end and a corresponding handle, wherein a relationship exists between two or more implements each having different working ends, such that as a length of the working end increases, the length of the corresponding handle decreases. The implement includes a handle length Hl and a working end length WEl. The handle length Hl measured from the first end 14 of the handle 12 to the second end 16 of the handle 12 may range from about 15.0 inches to 45.0 inches and the working end length WEl, measured from the top portion 20 of the working end 18 to the bottom portion 22 of the working end 18, is typically less than 15.0 inches. As demonstrated in FIG. 4, as the working end length WEl of the working end increases, the length of the corresponding handle decreases.

In certain embodiments, the overall length of each of the plurality of implements, described herein as the first length l and calculated by adding the handle length Hl to the working end length WEl, is substantially the same or standardized. The first length l may range from about 20.0 inches to about 50.0 inches. As described hereinabove, however, a handle-attachment member 26 may be releasably secured to the handle 12 by a user interested in increasing the first length l of one or more of the implements to a second length l', shown at FIGS. 2A & 2B.

In another aspect, implements of the present invention may be shipped in various configurations to a destination. The shipping methods of the present invention seek to save costs and maximize use of available shipping space.

Figure 5:
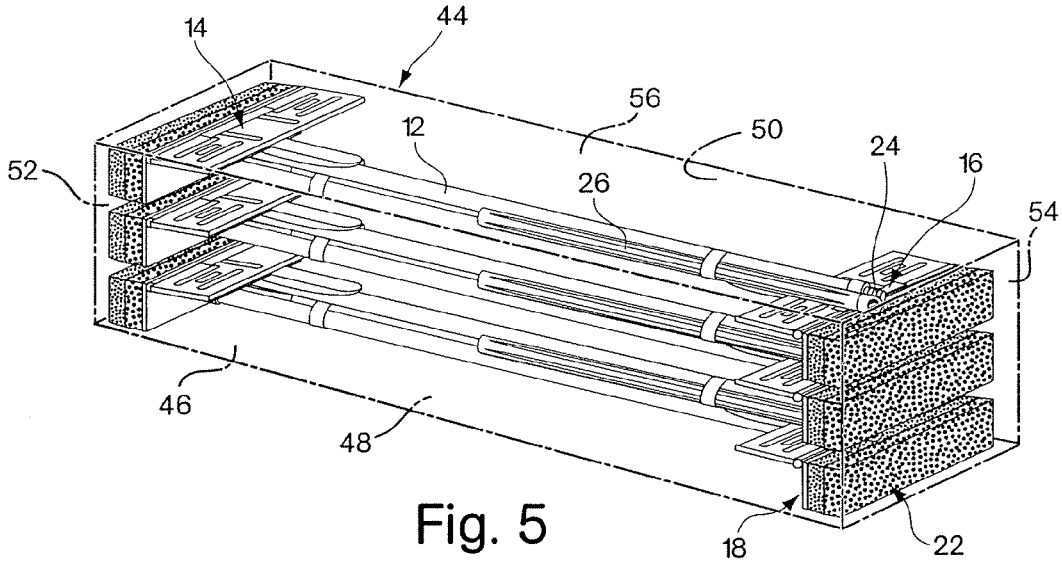
FIG. 5 is an elevated front view of one embodiment of the shipping container of the present invention.

In one embodiment, the shipping method comprises shipment of a plurality of implements, all of which include substantially the same length (the first length l). Referring now to FIG. 5, an embodiment of a shipping container 36 of the present invention, holding the plurality of implements, is shown. Each implement 10 of FIG. 5 comprises the handle 12 having the first end 14 and the second end 16 and the working end 18 having the top surface 20 and the bottom surface 22. The first end 14 of the handle 12 is attached to the top surface 20 of the working end 18.

As previously mentioned, each of the implements in the shipping method includes substantially the same length, measured from the second end 16 of the handle 12 to the bottom surface 22 of the working end 18—designated as the first length l, on FIGS. 1 and 2. This first length l is extendable to the second length l' by a user.

The shipping method generally involves a number of steps, the order of which may be altered, depending on the needs of the user.

First, the shipping container 44 is provided. As shown in FIG. 5, the shipping container 44 includes a dimension adapted to receive the first length l of the plurality of implements. Typically, the dimension is just large enough to allow the first length of the implements to fit within the container. Most often, the dimension is about 1.0 inch larger than the first length l of the implements being shipped. As shown in FIG. 5, the shipping container may be a corrugated cardboard box comprising a base 46, front and back sidewalls 48 and 50, left and right sidewalls 52 and 54 and a top 56 that can be opened and closed by a user. The shipping container 44 of the present invention may be a box that ranges in size from 40.0 inches by 4.0 inches by 2.0 inches to 40.0 inches by 48.0 inches by 48.0 inches, but is typically about 40.0 inches by 10.0 inches by 10.0 inches. Depending on the dimensions of the boxes, a number of implements may be placed within. In a box that is 40.0 inches by 12.0 inches by 8.0 inches, about 12 or less implements may be placed within. In boxes with larger dimensions, more implements may be placed within.

Second, the implements, all of which include substantially the same length, are placed within the shipping container 44. In general, the plurality of implements are all sized to the first length l. In some embodiments, one or more handle-attachment members 26 may be secured to a side of the handle 12 during shipment. After shipment, the handle-attachment members 26 may be employed by end-users to extend the first length l to the second length l'. In other embodiments, two or more of the implements include different working ends. For example, brooms may be shipped with mops or long-handled garden implements with rakes.

Figure 6A:
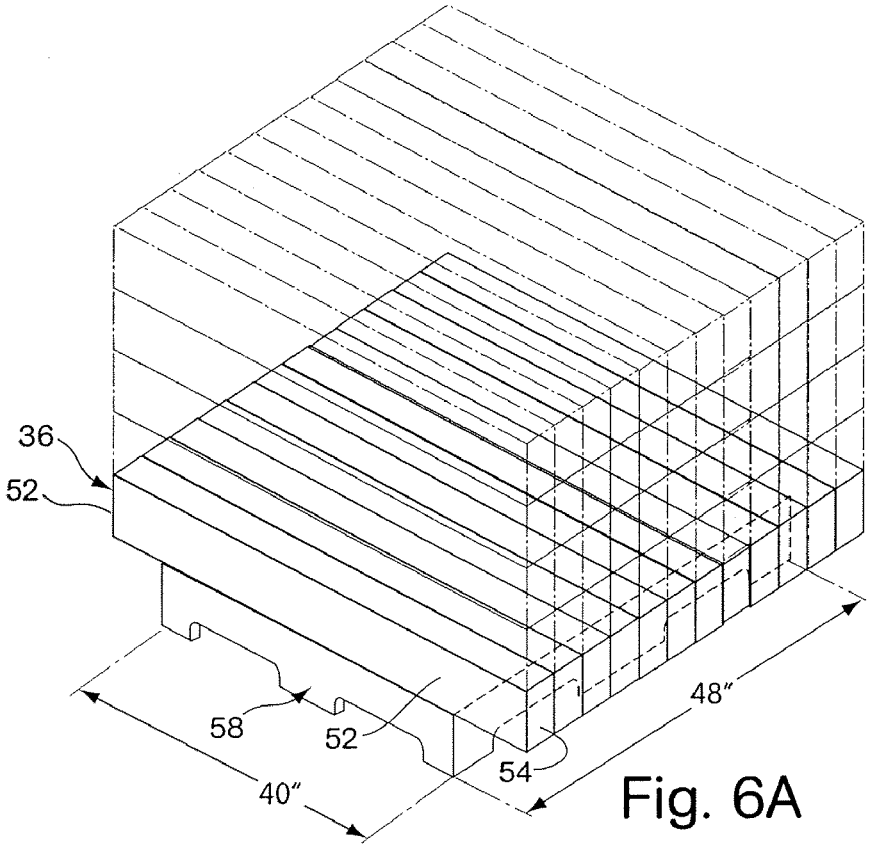
FIG. 6A is a perspective view of a pallet housing multiple shipping containers.

Third, two or more of the shipping containers 36 may be placed on a pallete 58. The typical dimensions of the pallete 58 include 48.0 inches by 40.0 inches. As shown in FIG. 6A, when shipping containers include lengths over 48.0 inches, for example between 48 and 62 inches, the ends of the shipping containers hang over the edges of the pallete. This leads to potential damage to the implements within the shipping containers and occupies unnecessary space in a warehouse or truck. When fork lift operators pick up the palletes, the shipping containers overhanging the palletes may be crushed when the palletes are repositioned against a wall in a warehouse. Importantly, all prior art methods for shipping implement product lines have included the use of at least some shipping containers linger than 48.0 inches. In many cases, based on the length of the implements in the line, shipping containers with lengths above 48.0 inches was the norm.

Figure 6B:
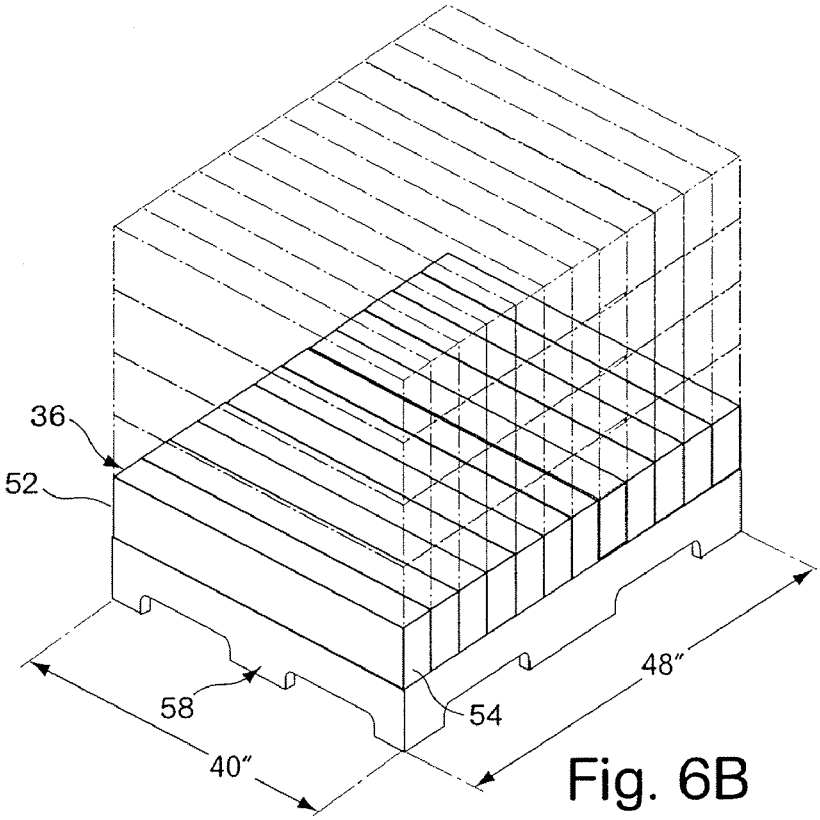
FIG. 6B is a perspective view of one embodiment of a pallet of the present invention housing multiple shipping containers.

On the other hand, in accordance with one embodiment of the present invention, when implements are standardized to include on overall length of about 39.0 inches, the shipping containers may be standardized to include a length of 40.0 inches. As shown in FIG. 6B, under these circumstances, the shipping containers do not overhang the edge of the pallet and a large space savings is achieved. For example, comparing one embodiment of the shipping container of the present invention, including dimensions of 40.0 inches by 10.0 inches by 10.0 inches with the shipping container of 6A, having dimensions of 55.0 inches by 10.0 inches by 10.0 inches, a space savings of approximately 30% is seen. More specifically, the shipping container of the present invention occupies a space of 4,000 (40×10×10) cubic inches, while the shipping container of FIG. 6A occupies a space of 5,500 (55×10×10) cubic inches. Dividing the 1,500 cubic inch difference by 5,500 yields a space savings of 27.2%.

In addition, through use of the instant invention, increased numbers of shipping containers may be shipped on a single standardized pallet, depending on their orientation. For example, assuming the shipping containers 36 are 8.0 inches by 40.0 inches, when the left and right sidewalls 52 and 54 of the shipping containers 36 are perpendicular to the 40.0 inch portion of the pallet 58, six shipping containers fit across the 48.0 inch portion of the single standardized pallet. If, however, some of the shipping containers 36 are more than 40.0 inches long (to receive implements with overall lengths more than 40 inches), the left and right sidewalls 52 and 54 of the shipping container 36 may be perpendicular to the 48.0 inch portion of the pallet and only 5 shipping containers fit across the 40.0 inch section of the pallet.

In Yet another aspect, implements of the present invention may be displayed, most often in a retail environment. The method of display may be helpful in maximizing the number of implements displayed in a way that is aesthetically pleasing to consumers.

Figure 7:
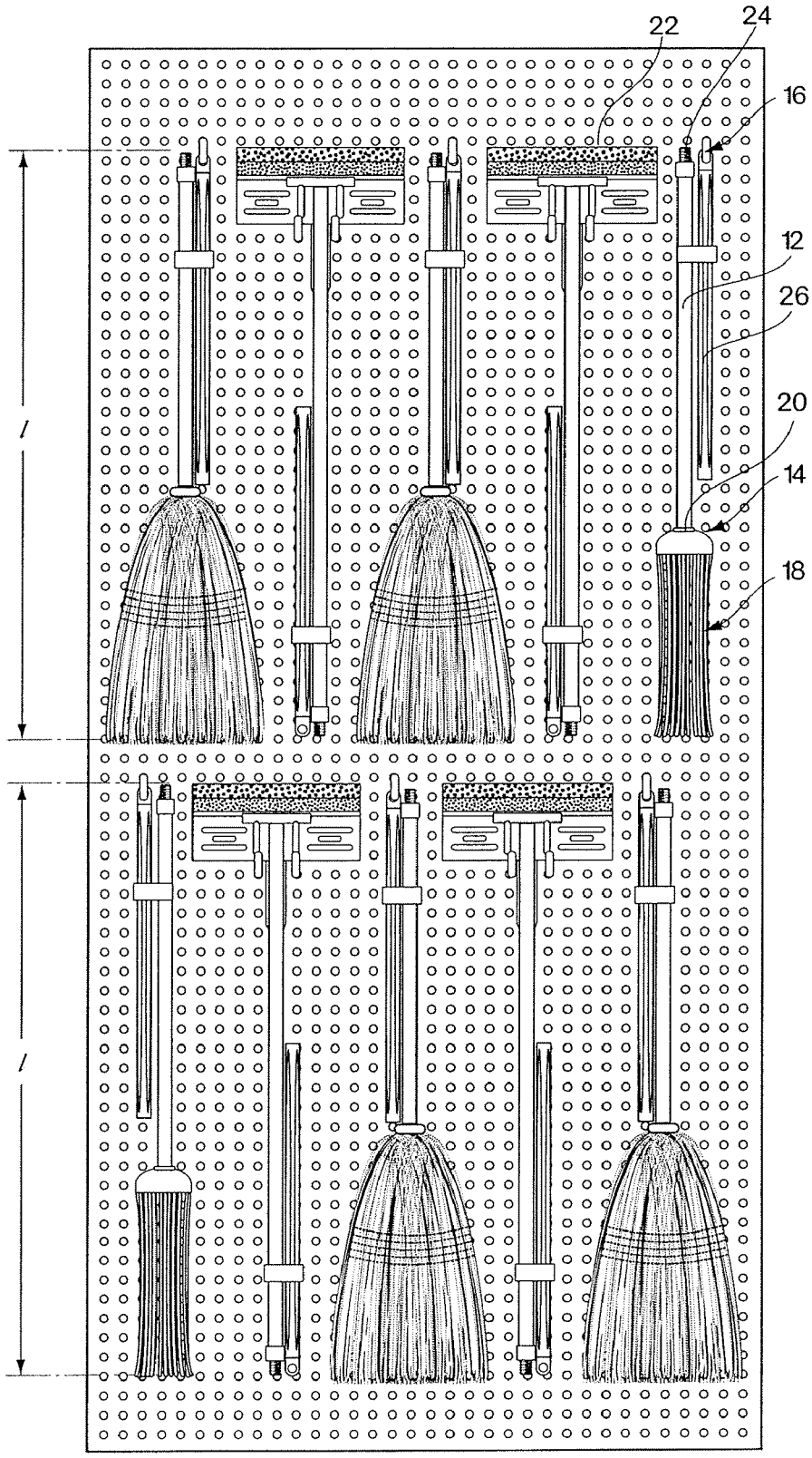
FIG. 7 is an elevated front view of the cleaning implements of the present invention on display in a retail environment.

In one embodiment, shown in FIG. 7, a plurality of implements are displayed on a two-tiered board in a retail environment. Each implement comprises a handle 12, which includes a first end 14 and a second end 16 and a working end 18, which includes a top surface 20 and a bottom surface 22. As shown in FIG. 7, the first length l of each implement, measured from the second end 16 of the handle 12 to the bottom surface 22 of the working end 18 is substantially the same. The first length l may be extended by a user through a handle-attachment member 26 or the other above-described methods. As further shown in FIG. 7, the implements are hung from hooks in an alternating pattern, such that, the second end 16 of each handle 12 is aligned with the bottom portion 22 of each adjacent implement. This type of arrangement not only saves space, particularly when adjacent implements are displayed as close as possible to one another, but is aesthetically pleasing to consumers.

Variations, modifications and other implementations of what is described herein will occur to those of ordinary skill in the art without departing from the spirit and scope of the invention. Accordingly, the invention is in no way limited by the preceding illustrative description.

We claim:

1. A method for displaying cleaning implements in a retail environment comprising the steps of:

providing a plurality of implements, each implement comprising a handle comprising a first end and a second end, a working end, and a handle-attachment member releasably securable to a second end of the handle, wherein the first end of the handle is attached to the working end, the handle-attachment member is detached from the second end of the handle, and the implements include substantially the same first length comprising a distance from the second end of the handle to a bottom portion of the working end; and positioning the plurality of implements in a retail environment so that at least one working end is aligned with at least one of another working end and a second end of another implement.

2. The method of claim 1, wherein the handle-attachment member is adapted to extend the implement to a second length comprising a second distance from a bottom portion of the working end to a top end of the handle-attachment member.

3. The method of claim 1, wherein during the positioning step the implements are positioned on a retail board.

4. The method of claim 1, wherein the handle-attachment member comprises a threaded section for mating with a threaded section disposed on the second end of the handle.

5. The method of claim 1, wherein the handle-attachment member ranges in length from about 12 inches to about 20 inches.

6. The method of claim 1, further comprising attaching the handle-attachment member along a surface of the handle.

7. The method of claim 6, wherein the handle-attachment member is clipped to a side surface of the handle.

8. The method of claim 1, wherein at least two of the implements comprise different working ends.

9. The method of claim 1, wherein the implements are selected from the group consisting of mops, brooms and dusters, long-handled garden implements and rakes.

10. The method of claim 1, wherein the handle is releasably securable to the working end.

11. The method of claim 1, wherein the first length is within the range of about 15 inches to about 50 inches.

12. The method of claim 1, wherein the handle includes a handle length, measured from the first end of the handle to the second end of the handle, of between about 15 inches and 45 inches.

13. The method of claim 1, wherein the working end includes a working end length, measured from a top portion of the working end to a bottom portion of the working end, of less than about 15 inches.

14. The method of claim 1, further comprising hanging the implements from hooks during the positioning step.

15. The method of claim 1, wherein during the positioning step at least one working end is aligned with at least one second end.

16. The method of claim 1, wherein during the positioning step at least one working end is aligned with at least another working end.

17. The method of claim 1, wherein during the positioning step the handles are aligned in a parallel formation.

18. The method of claim 1, wherein during the positioning step the handles are aligned in a vertical formation.

19. The method of claim 2, wherein the second length is 70 inches or less.

20. The method of claim 1, wherein during the positioning step said at least one working end is vertically aligned with at least one of said another working end and said second end of another implement.

21. The method of claim 1, wherein during the positioning step the plurality of implements are positioned adjacent to one another.

* * * * *